US011136906B2

(12) United States Patent
Van Wingerden et al.

(10) Patent No.: US 11,136,906 B2
(45) Date of Patent: Oct. 5, 2021

(54) ADDED MOTION DUAL LIFT ROCKER ARM

(71) Applicant: Eaton Intelligent Power Limited, Dublin (IE)

(72) Inventors: Mark Van Wingerden, Battle Creek, MI (US); Kalen R. Vos, West Lafayette, IN (US); James E. McCarthy, Jr., Kalamazoo, MI (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 16/762,655

(22) PCT Filed: Nov. 12, 2018

(86) PCT No.: PCT/EP2018/080944
§ 371 (c)(1),
(2) Date: May 8, 2020

(87) PCT Pub. No.: WO2019/092245
PCT Pub. Date: May 16, 2019

(65) Prior Publication Data

US 2021/0047947 A1 Feb. 18, 2021

Related U.S. Application Data

(60) Provisional application No. 62/584,405, filed on Nov. 10, 2017.

(51) Int. Cl.
*F01L 1/34* (2006.01)
*F01L 1/18* (2006.01)
(Continued)

(52) U.S. Cl.
CPC ..... *F01L 1/181* (2013.01); *F01L 1/267* (2013.01); *F01L 13/0036* (2013.01); *F01L 2001/467* (2013.01); *F01L 2305/00* (2020.05)

(58) Field of Classification Search
CPC ..... F01L 1/181; F01L 1/267; F01L 13/0036; F01L 2001/467; F01L 2305/00
See application file for complete search history.

(56) References Cited

U.S. PATENT DOCUMENTS 4,726,332 A 2/1988 Nishimura et al.
5,758,620 A 6/1998 Warner
(Continued)

FOREIGN PATENT DOCUMENTS

DE 3613945 A1 10/1986
EP 3170997 A1 5/2017
(Continued)

OTHER PUBLICATIONS

International Search Report and Written Opinion for PCT/EP2018/080944, dated Jan. 28, 2019, pp. 1-16.

*Primary Examiner* — Zelalem Eshete
(74) *Attorney, Agent, or Firm* — Mei & Mark, LLP

(57) ABSTRACT

A rocker arm assembly comprises a first arm, a second arm, and a latch assembly. The first arm comprises a main cam interface end, a body comprising a shaft port configured to pivot on a rocker shaft, and a valve end configured to lift and lower when the main cam interface end is acted on by a cam lobe. The second arm is overlaid on the first arm. The second arm comprises a secondary cam interface end, a latch lip end, and a shell connecting the latch lip end and the secondary cam interface end. The shell is configured to pivot relative to the first arm. The latch assembly is mounted to the body. The latch assembly is configured to selectively latch and unlatch the first arm with respect to the second arm.

18 Claims, 4 Drawing Sheets

(51) Int. Cl.

| | |
|---|---|
| ***F01L 1/26*** | (2006.01) |
| ***F01L 13/00*** | (2006.01) |
| *F01L 1/46* | (2006.01) |

(56) References Cited

U.S. PATENT DOCUMENTS

| | | | | |
|---|---|---|---|---|
| 6,000,374 | A * | 12/1999 | Cosma | F01L 1/267 123/321 |
| 2004/0123825 | A1* | 7/2004 | Nagano | F01L 1/267 123/90.16 |
| 2007/0186890 | A1* | 8/2007 | Zurface | F01L 1/185 123/90.44 |
| 2012/0260873 | A1 | 10/2012 | Dietel et al. | |
| 2015/0122220 | A1* | 5/2015 | Cecur | F01L 1/2411 123/321 |
| 2017/0145876 | A1 | 5/2017 | Pham | |

FOREIGN PATENT DOCUMENTS

| | | | |
|---|---|---|---|
| JP | H07332048 | A | 12/1995 |
| WO | WO-2009/151352 | A1 | 12/2009 |
| WO | WO-2011/032632 | A1 | 3/2011 |

* cited by examiner

ADDED MOTION DUAL LIFT ROCKER ARM

This is a § 371 National Stage entry of PCT/EP2018/080944 filed Nov. 12, 2018, which claims priority to U.S. provisional patent application 62/584,405 filed Nov. 10, 2017 all of which are incorporated herein by reference.

FIELD

This application provides a rocker arm for a Type III overhead cam engine, the rocker arm comprising a latch assembly for enabling selection between two lift profiles.

BACKGROUND

Variable valve actuation on an engine system can improve fuel economy under certain operating conditions. It is desirable to switch between a standard lift profile and another lift profile. This can lead to complicated valvetrains.

SUMMARY

The systems and methods disclosed herein overcome the above disadvantages and improves the art by way of a rocker arm assembly. A rocker arm assembly comprises a first arm, a second arm, and a latch assembly. The first arm comprises a main cam interface end, a body comprising a shaft port configured to pivot on a rocker shaft, and a valve end configured to lift and lower when the main cam interface end is acted on by a cam lobe. The second arm is overlaid on the first arm. The second arm comprises a secondary cam interface end, a latch lip end, and a shell connecting the latch lip end and the secondary cam interface end. The shell is configured to pivot relative to the first arm. The latch assembly is mounted to the body. The latch assembly is configured to selectively latch and unlatch the first arm with respect to the second arm.

Additional objects and advantages will be set forth in part in the description which follows, and in part will be obvious from the description, or may be learned by practice of the disclosure. The objects and advantages will also be realized and attained by means of the elements and combinations particularly pointed out in the appended claims.

It is to be understood that both the foregoing general description and the following detailed description are exemplary and explanatory only and are not restrictive of the claimed invention.

DETAILED DESCRIPTION

Reference will now be made in detail to the examples which are illustrated in the accompanying drawings. Wherever possible, the same reference numbers will be used throughout the drawings to refer to the same or like parts. Directional references such as "left" and "right" are for ease of reference to the figures.

Figure 1:
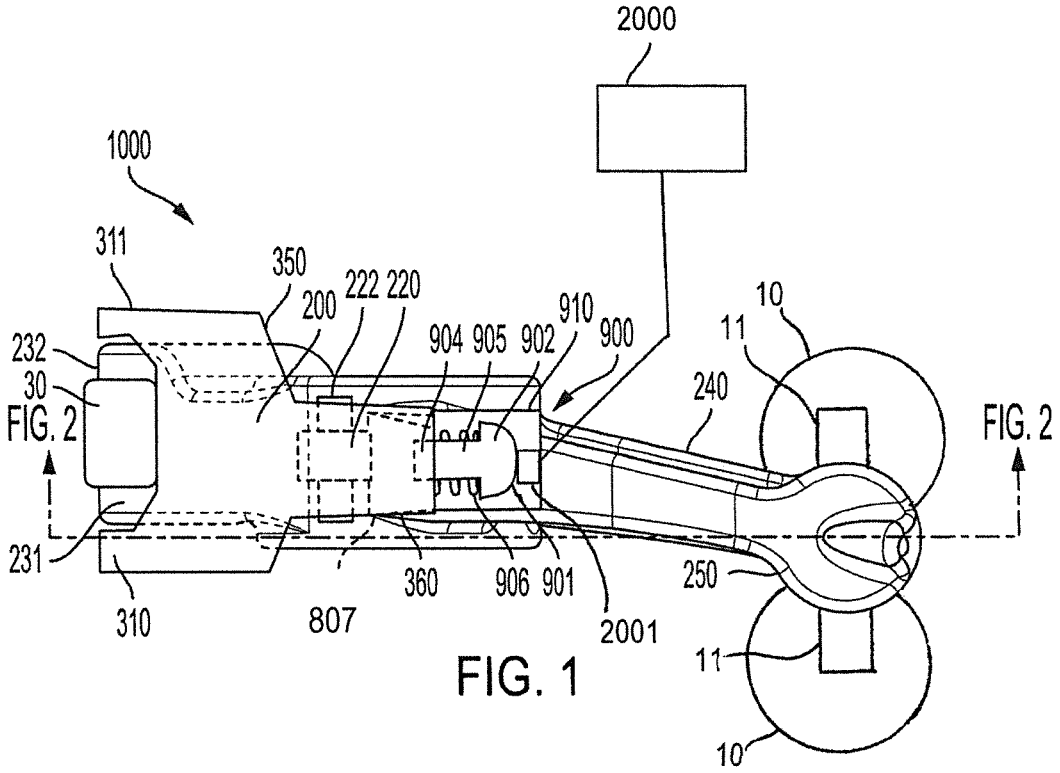
FIG. 1 is a top view of a rocker arm assembly.
Figure 2:
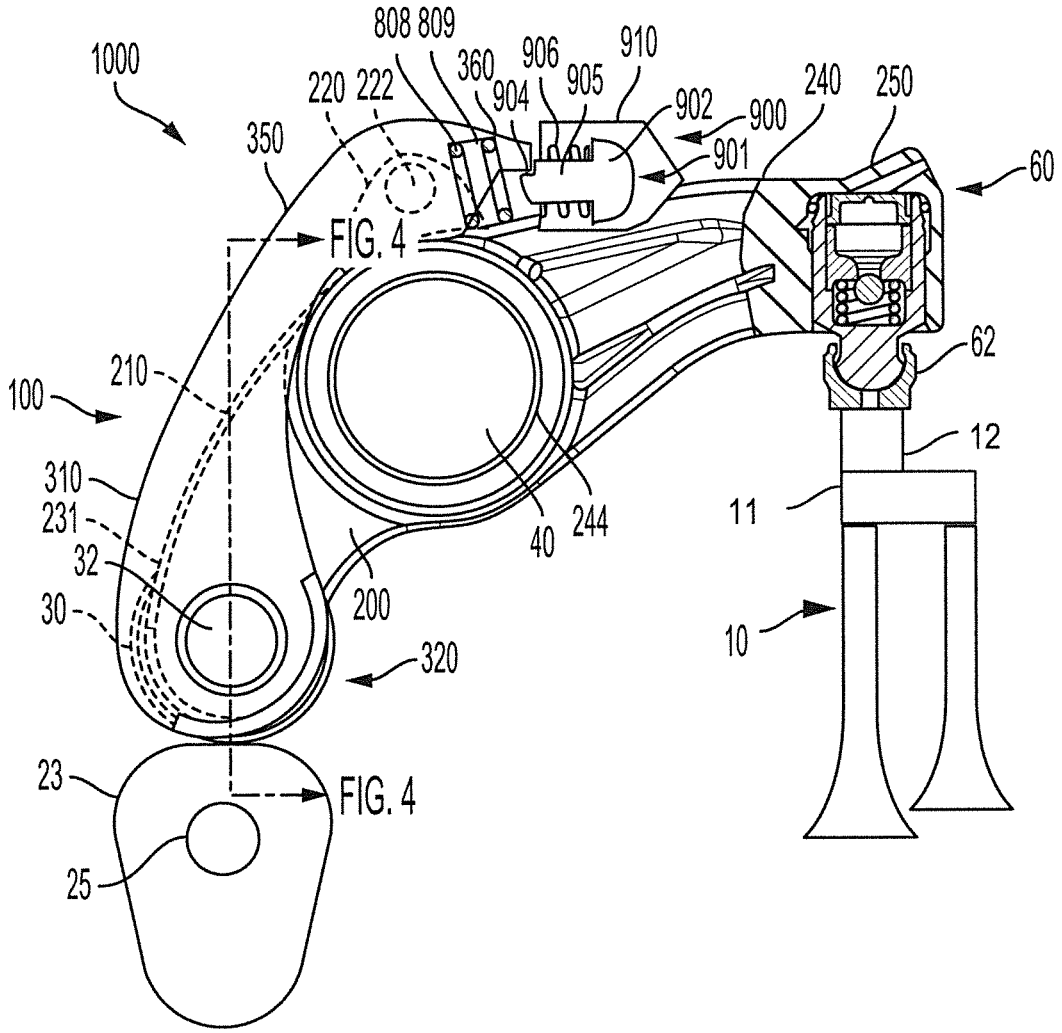
FIG. 2 is a cross section view of the rocker arm assembly.
Figure 4:
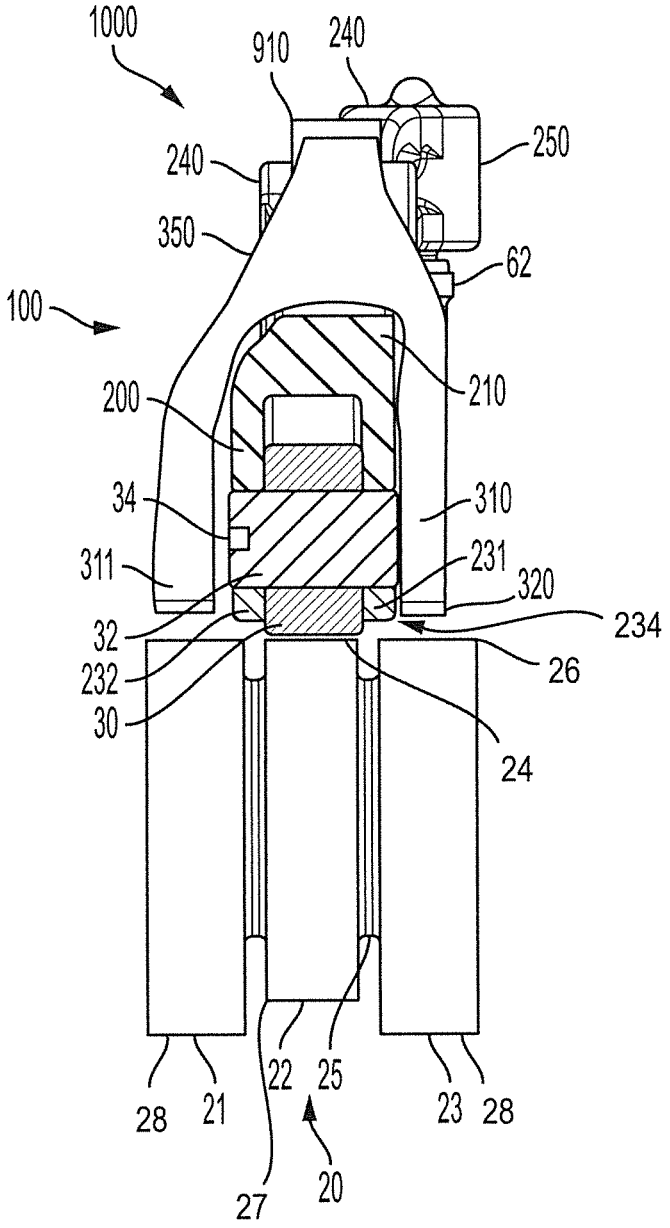
FIG. 4 is an alternative cross section view of the rocker arm assembly.

As shown in FIGS. 1, 2 & 4, a rocker arm assembly 1000 can comprise a first arm 200, a second arm 300, and a latch assembly 900. The first arm 200 comprises a main cam interface end 234, a body 210 comprising a shaft port 244 configured to pivot on a rocker shaft 40, and a valve end 250 configured to lift and lower when the main cam interface end 234 is acted on by a main cam lobe 22. The main cam interface end 234 can be forked by roller extensions 231, 232 to mount a roller assembly. The roller assembly can comprise a roller 30 on an axle 32. Axle 32 can comprise an attachment area 34. In lieu of a roller assembly, a slider pad can be arranged.

The main cam 22 can be part of a triple lobe overhead cam assembly 20. Outer cams 21 & 23 can interface with the second arm 300. A cam shaft 25 can connect the main cam 22 and outer cams 21, 23 for rotation. An alternative cam assembly can comprise a single outer cam 21 or 23. The main cam lobe 22 can impart a lift profile to the inner arm 20, while the at least one outer lobe 21 or 23 imparts a second lift profile to the second arm 300.

The second arm 300 is overlaid on the first arm 200. The second arm 300 comprises a secondary cam interface end 320, a latch lip end 360, and a shell 350 connecting the latch lip end 360 and the secondary cam interface end 320. The shell 350 is configured to pivot relative to the first arm. The secondary cam interface end 320 can comprise a slider pad 322 or a roller assembly. The secondary cam interface end 320 can be forked to comprise dual secondary cam interface ends 310, 311 as shown in FIG. 4 so as to flank the main cam interface end 231, 232.

The body 210 can further comprise a knurl 220 and a pivot axle 222 through the knurl 220. The shell 350 can further comprise a mounting for pivoting on the pivot axle. The mounting can comprise holes in line with the axle so that the axle 222 passes through the shell 350, as shown in FIG. 1. An alternative mounting can comprise cleats, detents, or grooves, among others.

The latch assembly 900 is mounted to the body 210. The latch assembly 900 is configured to selectively latch and unlatch the first arm 200 to the second arm 300. A controller 2000 can be programmed or can accept user inputs to control an actuator 2001 attached to a latch pin 901. The actuator 2001 can be a mechanical device, an electrical device, a combined electro-mechanical device, or a hydraulic device among others configured to move the pin 901 within the latch assembly 900. The latch assembly 900 can comprise a latch housing 910, the pin 901, and a latch spring 906 coiled around a neck 905 of the pin. The latch housing 910 can be mounted to, or integrally formed with, the body 210. The latch spring 906 can be biased between the latch housing 910 and a head 902 of the pin. A leaf spring can be used alternatively, among others. Moving the pin 901 moves a catch portion 904 of the pin 901 to selectively latch and unlatch the first arm 200 with respect to the second arm 300.

The rocker arm assembly can be arranged so that the body 210 further comprises a body spring pocket 807 and the shell further comprises a shell spring pocket 809. A spring 808 can be biased against the shell spring pocket 809 and the body spring pocket 807 to bias separation of latch lip end 360 and body 210. A coil or leaf spring can be oriented as spring 808. When the one or more secondary cam profiles push on the secondary cam interface ends 320, 312, and when the latch assembly 900 is unlatched as by retracting the latch pin 901, the latch lip end 360 can pivot past the catch portion 904 of the latch pin 901 toward the body 210. The spring 808 can be biased to return the latch lip end 360 to a latchable position when the secondary cam returns to a base circle or other neutral position. Then the catch portion 904 can be actuated or biased to extend and latch the second arm 300, 302 with respect to the main arm 200.

When the catch portion 904 of the pin 901 is retracted to unlatch the first arm 200 with respect to the second arm 300, a main lift profile on the main cam lobe 22 can be transferred to the first arm 200. The second lift profile of the at least one outer cam lobe 21, 23 is transferred to the second arm 300, but the second arm pivots on the pivot axle 222 and the second lift profile is "lost motion" that does not transfer to the valve end. When the catch portion 904 is extended to latch the first arm 200 with respect to the second arm 300, a portion of the main lift profile on the main cam lobe 22 can be transferred to the first arm 200, and an additional, or second lift profile, can be imparted by the second arm 300 as by designing the at least one outer cam lobe 21, 23. The second lift profile can be transferred to the valve end to extend the motion of the valve end when the latch assembly is latched.

The rocker arm assembly 1000 and 1002 comprises a cam shaft 25, the cam shaft comprising a main cam 22 configured to impart a first lift profile to the main cam interface end 234, 230. At least one secondary cam 21, 23 is configured to impart a second lift profile to the secondary cam interface end 312, 320. The secondary lift profile comprises a matching portion 26 and an extended duration portion 28. The first lift profile is imparted by selecting the contours of the main cam 22, and the second lift profile is imparted by selecting the contours of the secondary cams 21, 23. By virtue of its contours, the first lift profile comprises a velocity and lift profile for lifting and lowering the valve end 250. And, by virtue of the contours of the at least one secondary cam 21, 23, the matching portion 26 comprises a profile to match the velocity and lift profile of the main cam lobe 22. Such matching can be seen in FIG. 4, where matching portion 26 flanks matched portion 24 of the main cam 22. The extended duration portion 28 is configured to lower the valve end 250 at a second velocity and lift profile different than the velocity and lift profile of the first lift profile. Such difference can be seen in FIG. 4, where extended duration portion 28 comprises a longer cam lobe profile than the main lift portion 27 of the main cam lobe 22.

The rocker arm assembly 1000 and 1002 can comprise a controller 2000 for controlling the latch assembly 900 to selectively latch and unlatch the first arm 200 to the second arm 300. The valve end 250 lifts and lowers according to the first lift profile when the controller controls the latch assembly to unlatch. The valve end lifts 250 and lowers according to a portion of the first lift profile and according to the extended duration portion of the second lift profile when the controller controls the latch assembly to latch. Such use of both the first lift profile and the second lift profile can be designed as by controlling the contours of the main and secondary cam lobes 22, 21, 23 so that when the first lift profile is imparted, that portion of the main cam lobe extends circumferentially with respect to the cam axle 25 past the secondary cam lobe profile; and, when the secondary lift profile is imparted, that portion of the secondary cam lobe extends circumferentially with respect to the cam axle 25 past the main cam lobe.

Figure 3:
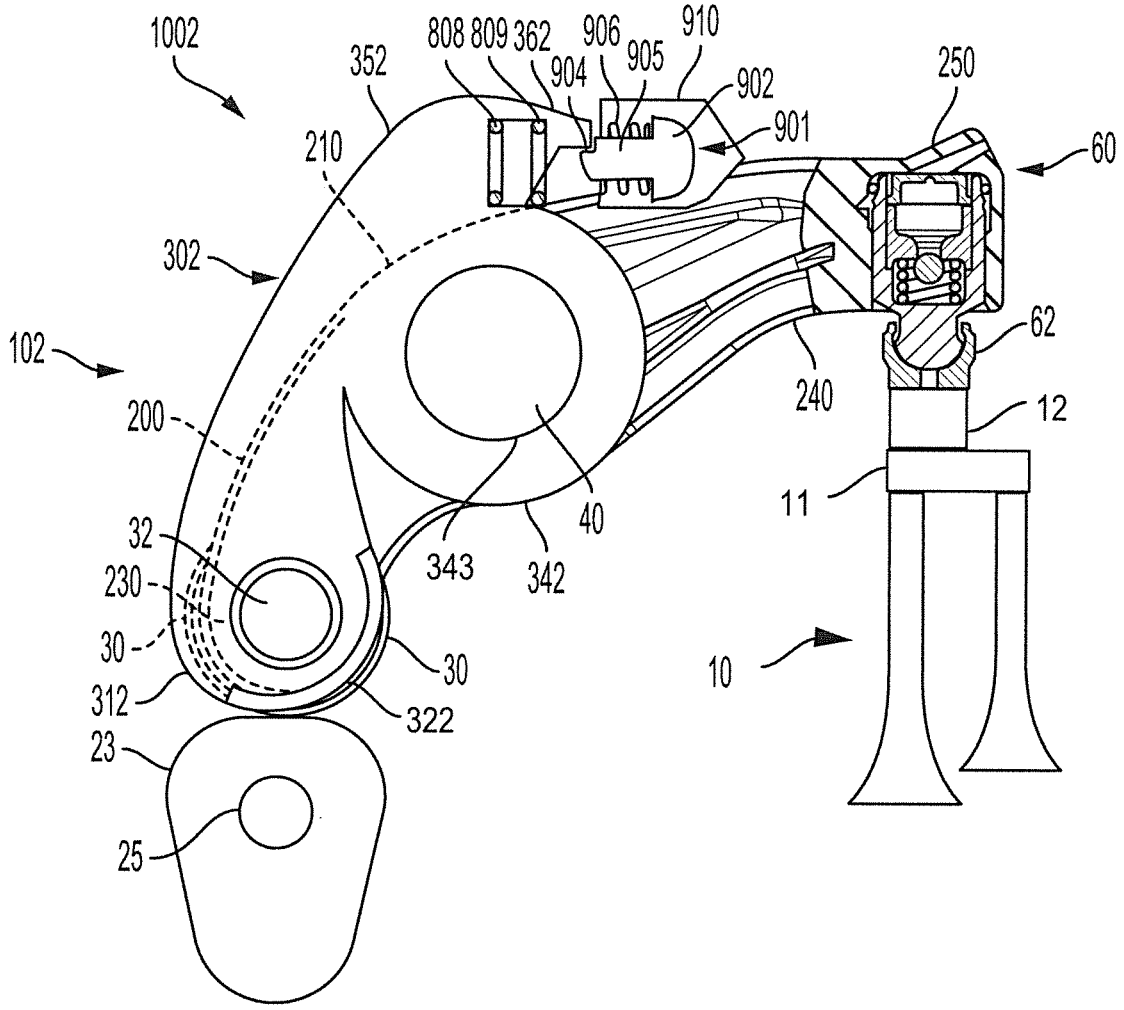
FIG. 3 is a cross section view of an alternative rocker arm assembly.

In an alternative aspect shown in FIG. 3, the rocker arm assembly 1002 comprises a first arm 200, a second arm 302, and a latch assembly 900. Many aspects remain as described elsewhere herein, but the shell 352 comprises an extension 342 comprising a second shaft port 343 configured to pivot on the rocker shaft 40. The knurl 220 and pivot axle 22 can be omitted from the main body 200. The first arm 200 is as described elsewhere to comprise a main cam interface end 234, a body 210 comprising a shaft port 244 configured to pivot on a rocker shaft 40, and a valve end 250 configured to lift and lower when the main cam interface end 234 is acted on by a main cam lobe 22. The second arm 302 is overlaid on the first arm 200 so, like above, the second arm can pivot with respect to the first arm 200 when the latch assembly is unlatched, yet the second arm is locked not to pivot when the latch assembly is latched. In the FIG. 3 variant, the pivot location is moved from the knurl 220 and pivot axle 222 to the rocker shaft 40. The second arm continues to comprise a secondary cam interface end 312, a latch lip end 362, and a shell 352 connecting the latch lip end and the secondary cam interface end 312. The shell 352 is configured to pivot about the rocker shaft 40 relative to the first arm 200. The latch assembly 900 is mounted to, or integrated with, the body 210. The latch assembly is configured as described elsewhere herein to selectively latch and unlatch the first arm 200 to the second arm 302.

The valve end 250 can further comprise an actuatable capsule 60. By supplying controlled fluid to a port 61, or by alternatively supplying fluid internally within the body 210 via the rocker shaft 40, the capsule 60 can receive pressurized fluid to control the actuation of the actuatable capsule 60. Such functionality as lash adjustment, braking, deactivation, among others, can be imparted to the valve end 250 by appropriately selecting the actuatable capsule 60.

Actuatable capsule 60 or valve end 250 can comprise a valve coupler 62 such as an elephant foot ("e-foot"). While a single valve stem of a valve 10 can be connected for actuation with the valve coupler 62, it is also possible to have a multi-valve valve assembly, as drawn. This way, the dual lift selection of the rocker arm assembly 1000, 1002, particularly the added motion of the latched second arm 300, 302 and the lost motion of the unlatched second arm, can be applied to more than one valve 10 of an engine cylinder. The added motion can be implemented to hold one or more intake valves 10 open longer than the main lift profile for performing late intake valve closing (LIVC) or late exhaust valve closing (LEVC). By selecting whether the latch assembly is biased open or biased closed, and by selecting the main and secondary cam profiles, other variable valve actuation ("VVA") functions can be achieved, such as early intake valve opening (EIVO) or early exhaust valve opening (EEVO).

The valve assembly can be coupled to the valve coupler 62 of the valve end 250. The valve assembly can comprise a valve bridge 11 and two valves 10 coupled to the valve bridge 11. The valve coupler 62 can interface with an extension 12, which in turn interfaces with a valve bridge 11, or the valve bridge 11 can be integral with the extension 12. Numerous alternatives can be implemented.

Other implementations will be apparent to those skilled in the art from consideration of the specification and practice of the examples disclosed herein.

What is claimed is:

1. A rocker arm assembly, comprising:

a first arm, comprising:

a main cam interface end;

a body comprising:

a shaft port configured to pivot on a rocker shaft; and a body spring pocket; and a valve end configured to lift and lower when the main cam interface end is acted on by a cam lobe;

a second arm overlaid on the first arm, the second arm comprising:

a secondary cam interface end;

a latch lip end; and a shell connecting the latch lip end and the secondary cam interface end, the shell configured to pivot relative to the first arm, the shell comprising a shell spring pocket;

a spring biased against the shell spring pocket and the body spring pocket; and a latch assembly mounted to the body, the latch assembly configured to selectively latch and unlatch the first arm with respect to the second arm.

2. The rocker arm assembly of claim 1, wherein the main cam interface end comprises a roller assembly.

3. The rocker arm assembly of claim 1, wherein the secondary cam interface end comprises a slider pad.

4. The rocker arm assembly of claim 1, wherein the latch assembly comprises:

a latch housing;

a pin; and a latch spring biased between the latch housing and the pin.

5. The rocker arm assembly of claim 1, wherein:

the body further comprises a knurl and a pivot axle through the knurl; and the shell further comprises a mounting for pivoting on the pivot axle.

6. The rocker arm assembly of claim 1, wherein the shell comprises an extension comprising a second shaft port configured to pivot on the rocker shaft.

7. The rocker arm assembly of claim 1, wherein the secondary cam interface end is forked to flank the main cam interface end.

8. The rocker arm assembly of claim 1, wherein the valve end further comprises an actuatable capsule.

9. The rocker arm assembly of claim 1, further comprising a cam shaft, the cam shaft comprising:

a main cam configured to impart a first lift profile to the main cam interface end; and at least one secondary cam configured to impart a second lift profile to the secondary cam interface end, the secondary lift profile comprising a matching portion and an extended duration portion.

10. The rocker arm assembly of claim 9, wherein the first lift profile comprises a contour for lifting and lowering the valve end, and wherein the matching portion comprises a profile to match the contour.

11. The rocker arm assembly of claim 10, wherein the extended duration portion is configured to lower the valve end at a second contour different than the contour of the first lift profile.

12. The rocker arm assembly of claim 11, further comprising a controller for controlling the latch assembly to selectively latch and unlatch the first arm to the second arm, wherein the valve end lifts and lowers according to the first lift profile when the controller controls the latch assembly to unlatch, and wherein the valve end lifts and lowers according to a portion of the first lift profile and according to the extended duration portion of the second lift profile when the controller controls the latch assembly to latch.

13. The rocker arm assembly of claim 1, further comprising a valve assembly coupled to the valve end, the valve assembly comprising a valve bridge and two valves coupled to the valve bridge.

14. A rocker arm assembly, comprising:

a first arm, comprising:

a main cam interface end;

a body comprising a shaft port configured to pivot on a rocker shaft; and a valve end configured to lift and lower when the main cam interface end is acted on by a cam lobe;

a second arm overlaid on the first arm, the second arm comprising:

a secondary cam interface end;

a latch lip end; and a shell connecting the latch lip end and the secondary cam interface end, the shell configured to pivot relative to the first arm; and a latch assembly mounted to the body, the latch assembly configured to selectively latch and unlatch the first arm with respect to the second arm, wherein the latch assembly comprises:

a latch housing;

a pin; and a latch spring biased in the latch housing to retract the pin into the latch housing and out of contact with the shell.

15. The rocker arm assembly of claim 14, wherein:

the body further comprises a body spring pocket;

the shell further comprises a shell spring pocket; and the rocker arm assembly further comprises a spring biased against the shell spring pocket and the body spring pocket.

16. The rocker arm assembly of claim 14, further comprising an actuator configured to push the pin into contact with the shell.

17. The rocker arm assembly of claim 14, wherein:

the body further comprises a knurl and a pivot axle through the knurl; and the shell further comprises a mounting for pivoting on the pivot axle.

18. A rocker arm assembly, comprising:

a first arm, comprising:

a main cam interface end;

a body comprising a shaft port configured to pivot on a rocker shaft; and a valve end configured to lift and lower when the main cam interface end is acted on by a cam lobe;

a second arm overlaid on the first arm, the second arm comprising:

a secondary cam interface end forked to flank the main cam interface end;

a latch lip end; and a shell connecting the latch lip end and the secondary cam interface end, the shell comprising an extension and a second shaft port configured to pivot the shell on the rocker shaft; and a latch assembly mounted to the body, the latch assembly configured to selectively latch and unlatch the first arm with respect to the second arm.

* * * * *